United States Patent [19]

Samis

[11] 4,254,552

[45] Mar. 10, 1981

[54] INSCRIBING SYSTEM

[76] Inventor: Philip L. Samis, 3470 Stanley St., Apt. 903, Montreal, Canada

[21] Appl. No.: 5,008

[22] Filed: Jan. 22, 1979

[51] Int. Cl.[3] ..... B43L 13/00

[52] U.S. Cl. ..... 33/18 R; 33/1 M; 318/568; 346/29

[58] Field of Search ..... 318/568; 346/29; 358/299; 33/1 M, 18 R, 25 D, 32 D

[56] References Cited

U.S. PATENT DOCUMENTS

| | | | |
|---|---|---|---|
| 3,786,429 | 1/1974 | Goldman et al. | 340/711 |
| 3,857,025 | 12/1974 | English | 318/568 |
| 3,873,769 | 3/1975 | Cotter | 33/1 M |
| 3,964,168 | 6/1976 | Uchida et al. | 33/1 M |

FOREIGN PATENT DOCUMENTS

| | | | |
|---|---|---|---|
| 1093146 | 11/1967 | United Kingdom | 33/18 R |

*Primary Examiner*—John W. Shepperd

*Attorney, Agent, or Firm*—Miller & Prestia

[57] ABSTRACT

An inscribing system that is electronically automated for transcribing onto miniature carriers character information which will positively identify the human, animal or valuable article in which the carrier is embedded. The automated inscribing system includes a microprocessor with memory and a plurality of peripheral interface adapters for interfacing between the microprocessor and other elements of the system. In the operation of the system, the character or characters to be inscribed on the carrier are selected from a keyboard which calls into operation the microprocessor program, and which thereby converts the designated character electrical signal received from the keyboard into a coded pulse train which operates stepping motors in an inscribing assembly for the inscription of the selected character or characters on the carrier chip surface. Also, display means are provided for the visual disclosure of the character or characters inscribed on the carrier chip.

15 Claims, 8 Drawing Figures

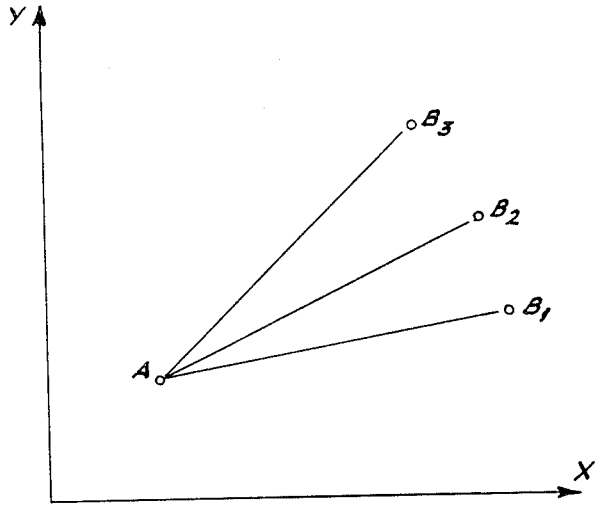
FIG. 3a.
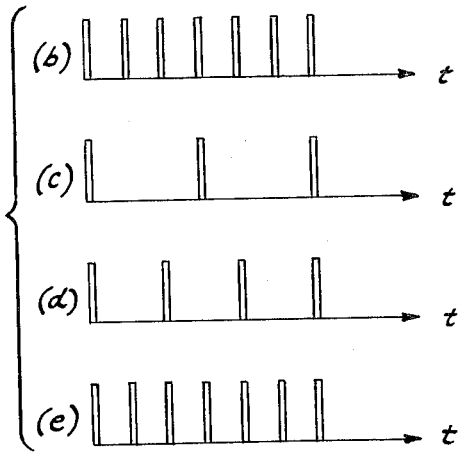
FIG. 3.
FIG. 4.
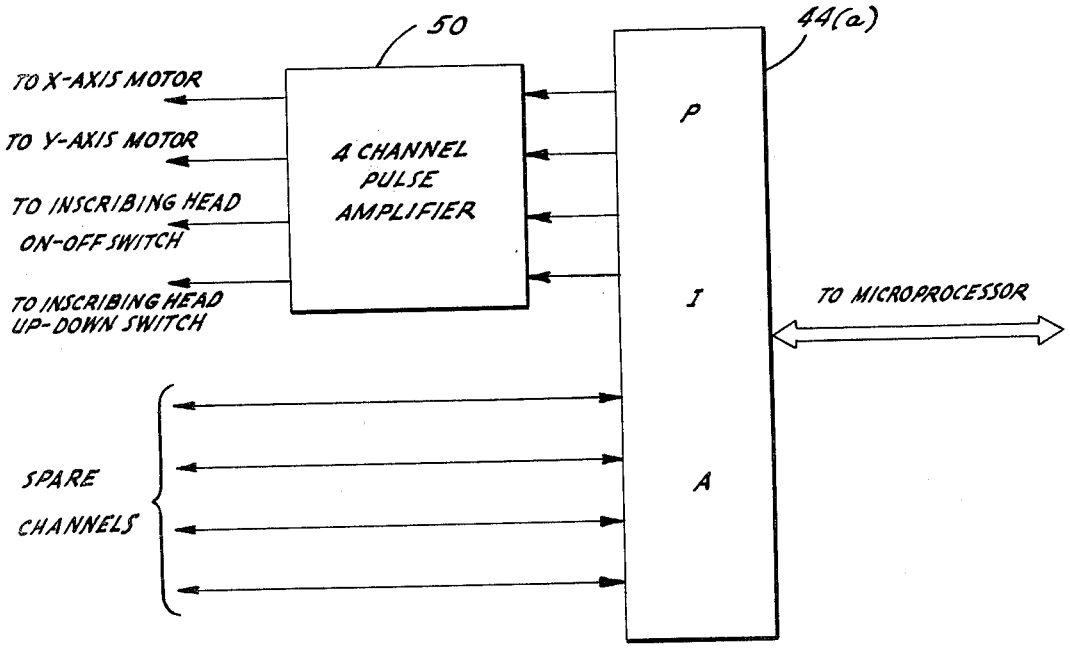

INSCRIBING SYSTEM

BACKGROUND OF THE INVENTION

The present invention relates to an automated system for inscribing information characters on a carrier chip. More specifically, the carrier chip is of the type designed for embedding into mineralized tissue in the human or animal body, or in valuable articles.

Airline crashes, wars and other disasters have resulted in a large number of human victims whose visual identification was impossible. Also, identifying valuable objects, such as jewelry, works of art, and other like articles upon recovery by police and other authorities has been most expensive and time consuming.

A method and structure for the rapid and low cost positive identification of human or animal bodies and valuable objects and general property control has been disclosed in applicant's U.S. Pat. No. 4,027,391, issued June 7, 1977 and applicant's Continuation-In-Part application, Ser. No. 771,744, now U.S. Pat. No. 4,168,586 filed Feb. 24, 1977. The method and structure therein described, refers to a miniature carrier chip on which is inscribed information positively identifying the human or animal or article in which the chip is embedded.

Typically, with respect to identification of humans the chip is embedded in a mineralized portion of the body, such as tooth, and the identifying information might include one's name, nationality and social security number. Teeth are relatively non-destructable and can withstand very high temperatures, thus even if the body is badly burned or decomposed the tooth with the carrier chip therein will remain intact. During the postmortem procedure the forensic odontologist will radiographically locate the carrier chip and thereafter remove it from the tooth for postmortem identification of the victim. Radiographic detection would likewise be used in the identification of valuable articles.

While the above-mentioned carrier chip is most advantageous in positive postmortem identification, or for the identification of valuable articles, a means for inscribing the identifying information on the carriers quickly and at a low cost is most desirable since there is a need for large numbers of the carrier chips. At least with respect to implanting the information carriers in the human body, it is anticipated that such could be performed during a routine visit to the dentist. After the dentist has excavated a cavity, and prior to his filling the cavity with an amalgam, or other restorative material, the carrier chip would be placed therein. Thus, an inscribing system which is maintained in the dental office and is affordable to the dentist or dental groups, and which can rapidly inscribe the identifying information onto the carrier with a minimal amount of training would be most beneficial.

These and other objects are accomplished by the automated inscribing system of the present invention.

SUMMARY OF THE INVENTION

The automated system of the present invention for inscribing characters into miniature carrier chips includes an inscribing means which makes contact with the carrier chip for inscribing characters thereon. A first means is provided for controlling the relative displacement of the inscribing means and the article with respect to each other in the direction of a first axis along the carrier chip surface, while a second means is further provided for controlling the relative displacement of the inscribing means and the article with respect to each other in the direction of a second axis along the article surface. The relative displacement activated by the first and second displacement means being upon inscribing contact of the inscribing means and the carrier chip. A controller means controls the movement of each of the first and second displacement means. Furthermore, the present invention includes means for selecting characters to be inscribed on the carrier chip and for signaling to the controller means the designated characters to be inscribed.

BRIEF DESCRIPTION OF THE DRAWINGS

FIG. 3A graphically shows the orientation of three lines designated as lines $A-B_1$, $A-B_2$ and $A-B_3$, and FIGS. 3(*b*)-(*e*), graphically describes the electrical pulse train sequences transmitted to stepping motors of the present invention for inscribing the lines as shown in FIG. 3A.

FIG. 4 is a flow diagram showing channel signal flow from the peripheral interface adapter which interfaces between the microprocessor and inscribing assembly of the present invention.

DETAILED DESCRIPTION OF THE INVENTION

Figure 1:
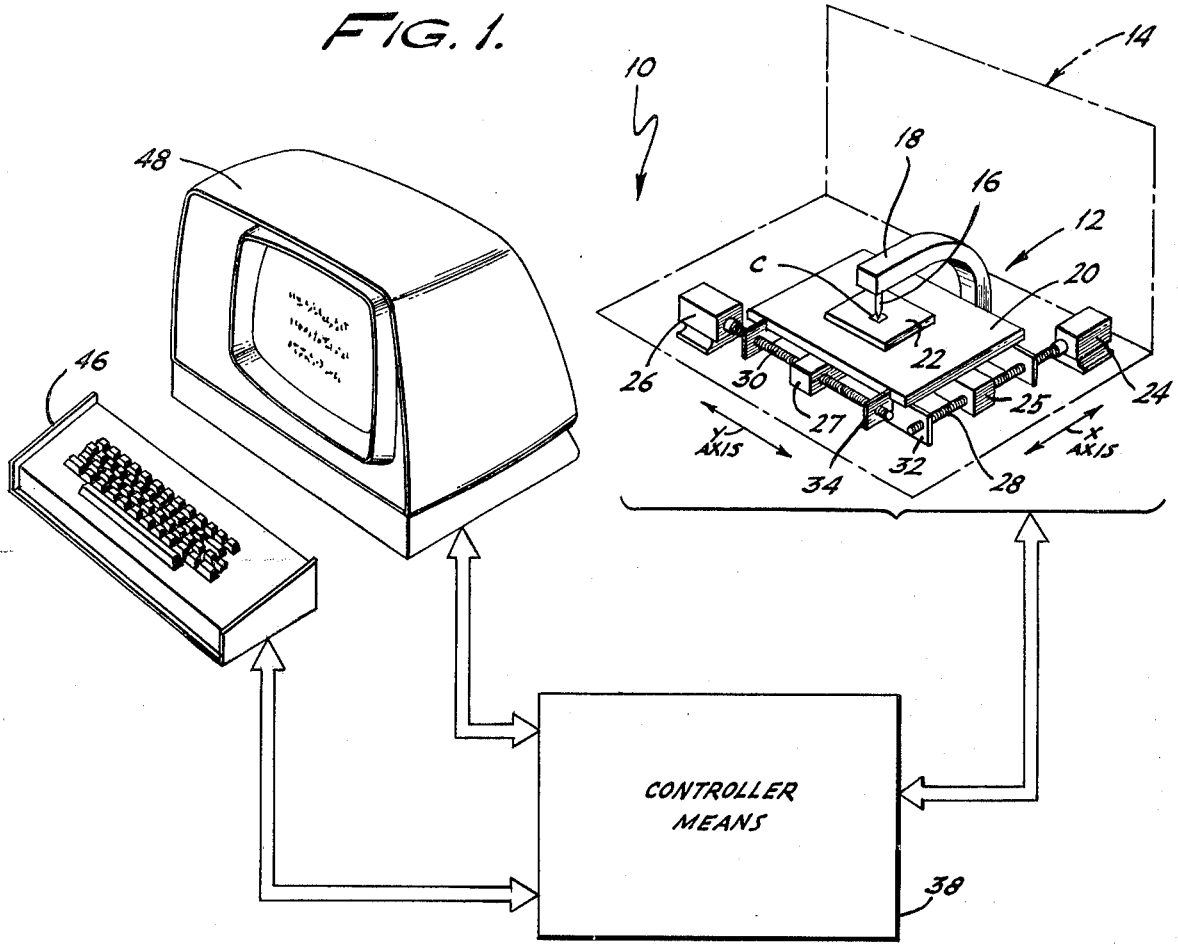
FIG. 1 is a schematic diagram, partially in perspective, of the inscribing system of the present invention.

Referring to the Figures, an automated inscribing system, for transcribing identifying information onto an article, is generally designated as 10. The article having the identifying information thereon, in the form of inscribed characters is described in detail in U.S. Pat. No. 4,027,391, herein incorporated by reference. For the purpose of describing the automated inscribing system of the present invention, the article is a carrier chip having a substrate of relatively hard inert material having a high melting point, e.g. a ceramic, and on a surface of the substrate is a layer of material suitable for having identifying characters inscribed thereon, e.g., gold. The carrier chip (hereinafter designated as C) is typically small, for example, about $1.26 \times 1.26$ mm are the dimension of the chip surface on which the characters are inscribed. The characters, typically alpha-numeric, are about 0.2016 mm in height and about 0.1134 mm wide.

The automated inscribing system 10 includes an inscribing assembly 12 having a housing 14 with an inscribing head 16 affixed to a mounting bracket 18 of a generally L-shaped curved structure. Inscribing head 16 may be of a conventional type, such as a piezoelectric activated system (as manufactured by Mastersonics Co. of Granger, Ind.) with a suitably mounted engraving tool. Flat mounting plate 20 is provided for demountable placement of a chip holder 22 having the carrier chip C demountably fixed thereon. Chip holder 22 is generally flat and plate-like. The chip carrier C may be temporarily fixed thereto by a suitable cement, or by other means like a slide attachment, guides, locking mechanism, mechanical retention means or a negative pressure retention mechanism.

The flat mounting plate 20 is itself oriented in the inscribing assembly 12, so that when the chip holder 22 and the chip C are mounted thereon, the vertical axis of the inscribing head 16 and the plane of the carrier chip inscribing surface are substantially perpendicular with respect to one another. This orientation will assure effective character inscription.

The flat mounting plate 20 is part of a conventional X-Y coordinate table which includes first and second stepping motors 24 and 26 which are within the housing 14 and mechanically linked to first and second lead screwdrivers 28 and 30. First screwdrive 28 engages a plurality of brackets 32 and by conventional linkage means 25 between the screwdrive 28 and plate 20, activation of the first stepping motor causes movement of the plate 20 along a first axis, identified hereafter as the X-axis. Second screwdrive 30 engages a plurality of brackets 34 in a direction orthogonal to the first screwdrive 28. By conventional linkage means 27 between the screwdrive 30 and plate 20, activation of the stepping motor 26 causes movement of the plate 20 in a second axis, thereinafter designated as the Y-axis. The X and Y axes are in substantially a 90° relationship with respect to each other. Thus, the simultaneous activation of both the first and second stepping motors 24 and 26 provide for the transcribing of two dimensional characters onto the carrier chip C along the X and Y axes.

The X-Y coordinate table can be of a type manufactured by Summit Industrial Products of Bozeman, Montana, 59715 and identified as Model 6102B.

Figure 2:
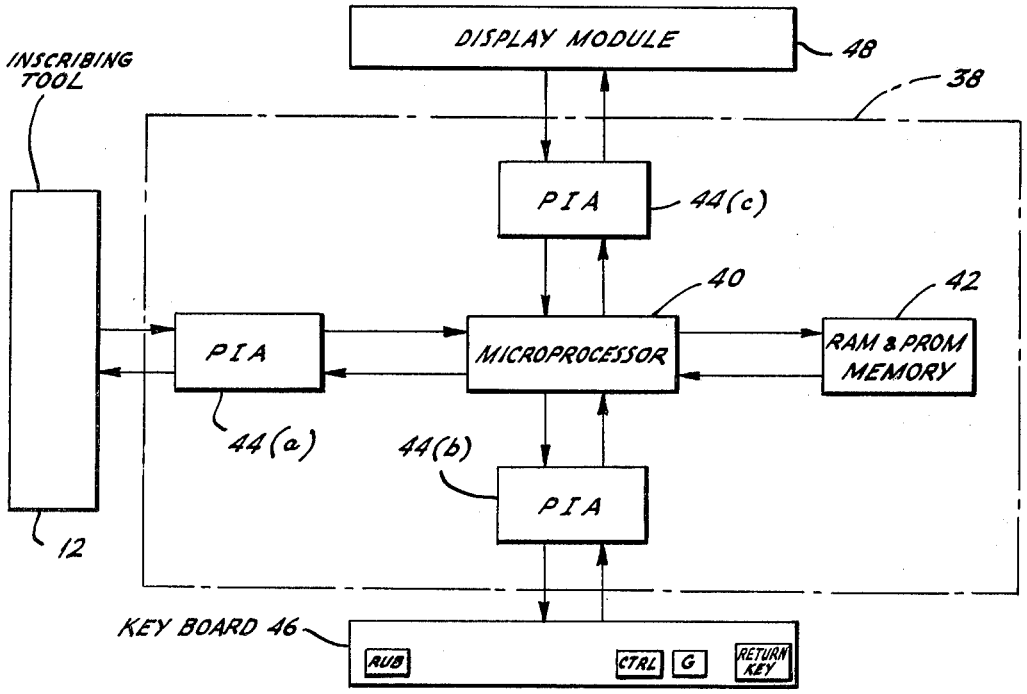
FIG. 2 is a block diagram describing the controller means of the present invention in relationship with other elements of the inscribing system.

The automated inscribing system 10 further comprises a controlling assembly 38 which electronically signals the activation of the first and second stepping motors 24 and 26, the activation of the inscribing head 16, and the raising and lowering of the inscribing head 16 in and out of contact with the inscribing surface of the carrier chip C. Typically, the electronic controlling assembly 38 includes a microprocessor with memory and a plurality of interface units, reference FIG. 2. For the purpose of describing the present invention, it will be assumed that the microprocessor 40 is of a conventional type, such as for example microprocessor MC 6802, manufactured by Motorola Semiconductors of Austin, Tex. This particular microprocessor is a monolithic 8-bit microprocessor. Microprocessor 40 is in association with a random-access memory (RAM) and a programmable read only memory (PROM), designated as 42, and are for example the RAM memory designated as 2102A and the PROM memory designated as 2716, both manufactured by Intel Corporation of Santa Clara, Calif.

The controller assembly 38 also includes three peripheral interface adapters designated as 44(A), 44(B) and 44(C) which provide for bidirectional data flow between microprocessor 40 and the other elements of system 10. The peripheral interface adapters 44(A), 44(B) and 44(C) provide a flexible means for connecting byte-oriented peripherals to the microprocessor 40. Specifically, peripheral interface adapter 44(A) interfaces between the inscribing assembly 12 and the microprocessor 40, while peripheral interface adapter 44(B) interfaces between microprocessor 40 and a keyboard 46, with PIA 44(C) interfacing between microprocessor 40 and a character display module 48.

It is assumed for the purpose of explanation that the keyboard 46 is of a conventional alpha-numeric type for example, model B80-31AA manufactured by the Cherry Company. As for display module 48, it will typically include solid-state alpha-number LED arrays for visual display of the characters to be inscribed onto the carrier chip C. The LED's may be of a type standard in the art, such as Hewlett-Packard's HDSP-2000.

The example of particular elements as set forth above is only for the purpose of describing the present invention, and other possible combinations can be utilized to implement the present invention.

The function of the controller assembly 38 is to accept the alpha-numeric text entered through the keyboard 46 by an operator, to display the designated text on the display module 48, and on the operator's command, to provide the necessary signals which will drive the inscribing assembly 12 for engraving of the designated text on the carrier chip C.

In addition, the controller assembly 38 may check for any possible malfunctioning, e.g. the absence or the improper positioning of the carrier chip C, excessive length or number of lines of the specified text, etc., and to disable the inscribing head and alert the operator of the malfunction.

In the operation of the automated inscribing system 10 of the present invention, when a character is entered by depressing a key on keyboard 46, the designated character is electronically transmitted to the display module 48 and appears on the read-out LEDs. Further, depressing of keys causes additional characters to be added, right to left in the same line. The maximum characters per line in this particular example is 11, blanks being counted as characters. By depressing a carriage return key on keyboard 46 the operator initiates a new line and the process is repeated. If the operator attempts to exceed the acceptable number of characters per line, the further most left bit, i.e., the 12th bit, in this line on the display module 48, flashes a warning character, e.g. an *. If an incorrect character is inadvertently punched through the keyboard 46, it can be removed by depressing the RUB key on the keyboard, followed by a two digit number ZX, where Z is the line and X is the character number, (counting from right to left), and the correct character can thereafter be punched in through the keyboard 46. All of these functions of the keyboard 46, i.e. text transfer from the keyboard, checking for character line numbers, and corresponding warning and correction procedure, are executed under program control.

When the operator is satisfied that the correct text appears on the display module he initiates the inscribing process by depressing the appropriate keys on the keyboard 46, for the particular keyboard mentioned above, these may be the keys designated as CTRL and G. Depressing these particular keys on keyboard 46 initiates the coding, checking and inscribing subroutines of the microprocessor 40.

Initiation of the coding subroutine converts each character displayed on the display module 48 into a sequence of electrical pulse signals or codes which are then stored in the RAM memory 42. The code sequence is used to generate the pulses which drive the first and second stepping motors 24 and 26. For each character the sequence of codes consist of a series of X-Y coordinates referenced to the lower left corner of the carrier chip C. In this manner, each character is transmitted to the carrier chip C in exactly the same order as it appears on the display module 48. Even after the entire code text is stored in the RAM memory, the designated characters are still displayed on the read-out LEDs of the display module 48. The coding subroutine of the microprocessor calls the checking subroutine.

The checking subroutine brings the inscribing head 16 to a position above the lower left corner of carrier chip C, and calls the inscribing subroutine into operation. If the checking subroutine determines that the carrier chip is not properly aligned at any time during the inscribing process, it disables the inscribing head 16 and flashes a warning, by means of a predetermined symbol, on the display assembly 48.

The inscribing subroutine of microprocessor 40 performs the following operations:

(a) Turns the inscribing head 16 on;

(b) brings the inscribing head 16 above the position specified by the first point (X-Y coordinates, stored in RAM) of the further most left character in the first line of the text;

(c) lowers the inscribing head 16;

(d) generates a series of pulses to the first and second stepping motors 24 and 26 for engraving the first character on the carrier chip C;

(e) lifts the inscribing head 16;

(f) repeats steps (b) through (e) for each remaining character in the text shown on display module 48;

(g) upon completion of the engraving process it turns off the inscribing head 16, and deletes the text from the display module 48 and displays "Inscribing Completed".

The operator can now remove the chip C containing the transcribed information from the chip holder 22, and the dentist can thereupon place the carrier chip C into a tooth of the patient.

With reference to FIGS. 3A to 3E, the manner of inscribing is subsequently described in more detail and in particular for a three straight lines from a point $A(Y_1—Y_1)$ to a point $B(Y_2—Y_2)$. Upon determining the number of poles of each of the first and second stepping motors 24 and 26 and the corresponding screwdrive gear ratio, one can calculate the number of pulses which will move the inscribing head 16 relative to the carrier chip C for a unit length on the carrier chip C. Thus, a straight line A–B is produced by supplying the first and second step motors 24 and 26 with a corresponding number of pulses. Note that, for the straight lines as shown in FIG. 3, the ratio of first stepping motor pulses to second stepping motor pulses has to be constant. Therefore, to engrave a straight line from point A to B the microprocessor program calculates the distance $\Delta X = X_2 - X_1$, and $\Delta Y = Y_2 - Y_1$ as well as their ratio, $\Delta Y$ over $\Delta X$. An appropriate pulse train is then supplied to each of the first and second stepping motors 24 and 26. In particular, the pulse train shown in FIG. 3(B) is the pulse train transmitted to the first stepping motor 24, i.e., the X-axis stepping motor, while the pulse trains shown in FIGS. 3(C) to 3(E) are transmitted to the second or Y-axis stepping motor 26 for engraving respectively lines $A–B_1$, $A–B_2$ and $A–B_3$.

Referring to FIG. 4 the peripheral interface adapter between microprocessor 40 and the inscribing assembly 12 is shown as an eight channel element. For the purpose of describing the present invention, two of the channels are utilized to drive pulses to the first and second stepping motors 24 and 26, one channel controls the up and down position of the inscribing head 16, another channel is used to switch the inscribing head on and off. Furthermore, a four channel pulse amplifier 60 amplifies the signals of the channels transmitting to the first and second stepping motors 24 and 26, switching on and off the inscribing head 16, and raising and lowering the inscribing head 16.

While in the present embodiment of the invention the first and second stepping motors have been described as moving the carrier chip with respect to the inscribing head 16, it is further anticipated by the present invention that the reverse is possible. That is, the stepping motors with their associated screwdrives may be utilized for movement of the inscribing head while the carrier chip C remains stationary.

While the character information in the present invention has been described as being alpha-numeric in nature, it is further anticipated that other identifying characters of a conventional type could also be utilized in designating particular person, animals or objects of value.

Therefore, the automated inscribing system of the present invention provides a rapid and inexpensive means for accurately inscribing character information on a carrier chip, where the operator of the inscribing system would require minimal training.

Although this invention has been described to specific embodiments thereof, it will be appreciated that various other modifications may be made, including the substitution of equivalent components or steps in substitution of those shown and described. Further, the invention comprehends the use of certain features independently of other features and the substitution of equivalent elements, all of which modifications may be made without departing from the spirit and scope of the invention as defined in the appended claims.

I claim:

1. A system for inscribing $\alpha$-numeric characters onto a miniature carrier chip comprising a substrate consisting of hard inert material having a high melting point and a surface layer for inscribing said characters for embedding into mineral tissue of humans or animals for purpose of reference at a future date comprising:

means for inscribing $\alpha$-numeric characters onto a surface of said carrier chip;

a first means for controlling the relative displacement of said inscribing means and the carrier chip with respect to each other in the direction of a first axis along the carrier chip surface, and a second means for controlling the relative displacement of said inscribing means and the carrier chip with respect to each other in the direction of a second axis along the carrier chip surface, said relative displacement being upon inscribing contact of said inscribing means and the carrier chip surface;

a controller means for controlling the movement of each of said first and second displacement means said controller means including a microprocessor with a memory and a plurality of peripheral interface adaptors for interfacing between said microprocessor and other elements of said system, one of said interface adapters interfacing between said means for inscribing characters and said microprocessor and another interface adapter interfacing between said microprocessor and a character display means;

means for selecting characters to be inscribed on the carrier chip and for signaling to said controller means the designated characters to be inscribed and means for displaying the selected characters.

2. The inscribing system in accordance with claim 1 wherein the characters are about 0.2016 mm high and about 0.1134 mm wide.

3. The inscribing system in accordance with claim 1 wherein the first and second axis along which said first and second displacement means control inscription of a character, are orthogonal with respect to each other.

4. The inscribing system in accordance with claim 1 said first displacement means being adapted for moving said carrier chip in the first axis along said article surface upon activation by said controller means, and said second displacement means being adapted for moving said carrier chip in the second axis and along said article surface upon activation by said controller means.

5. The inscribing system in accordance with claim 4 wherein said first and second displacement means are further adapted for simultaneous movement of the carrier chip along said first and second axis.

6. The inscribing system in accordance with claim 1 wherein said first displacement means being adapted for moving said inscribing means in the first axis along said carrier chip surface upon activation by said controller means, and said second displacement means being adapted to moving said inscribing means in the second axis along said carrier chip surface upon activation by said controller means.

7. The inscribing system in accordance with claim 6, wherein said first and second displacement means are further adapted for simultaneous movement of the inscribing means along said first and second axis.

8. The inscribing system in accordance with claim 1, wherein the carrier chip to be inscribed is placed on a flat mounting plate.

9. The inscribing system in accordance with claim 8 further comprising an carrier chip holder for retention of the article thereon, said carrier chip holder adapted for demountable placement onto said mounting plate.

10. The inscribing system in accordance with claim 1 wherein said character selecting means is a keyboard, said keyboard adapted for selection of a character to be inscribed upon the depression of a key designating said character.

11. The inscribing system in accordance with claim 10 further comprising a means for visually displaying the selected character.

12. The inscribing system in accordance with claim 11, wherein said display means has a plurality of LED modules on which the selected characters are shown.

13. The inscribing system in accordance with claim 11, wherein said microprocessor is programmed to receive a signal from said keyboard designating a character and converts said signal into an electrical pulse train for signaling and driving said first and second displacement means in simultaneous movement thereby inscribing said selected character onto the carrier chip.

14. The inscribing system in accordance with claim 13, wherein said microprocessor is further programmed to check the proper alignment between said inscribing means and said carrier chip.

15. The inscribing system in accordance with claim 1, wherein the characters are information characters which designate a particular human, animal or object.

* * * * *